US011815111B2

(12) United States Patent
Williams

(10) Patent No.: US 11,815,111 B2
(45) Date of Patent: Nov. 14, 2023

(54) MULTI-FUNCTIONAL MICROSTRUCTURED SURFACE DEVELOPMENT THREE DIMENSIONAL FORM SOLUTIONS IN INDIVIDUAL TILE AND MULTIPLE TILE ARRAY CONFIGURATIONS

(71) Applicant: Bruce Preston Williams, Grosse Pointe Park, MI (US)

(72) Inventor: Bruce Preston Williams, Grosse Pointe Park, MI (US)

(73) Assignee: Bruce Preston Williams, Grosse Pointe Park, MI (US)

( * ) Notice: Subject to any disclaimer, the term of this patent is extended or adjusted under 35 U.S.C. 154(b) by 0 days.

(21) Appl. No.: 17/693,381

(22) Filed: Mar. 13, 2022

(65) Prior Publication Data

US 2022/0290699 A1 Sep. 15, 2022

Related U.S. Application Data

(60) Provisional application No. 63/161,109, filed on Mar. 15, 2021.

(51) Int. Cl.
*F15D 1/00* (2006.01)

(52) U.S. Cl.
CPC ..... *F15D 1/004* (2013.01)

(58) Field of Classification Search
CPC ..... F15D 1/003–005
See application file for complete search history.

(56) References Cited

U.S. PATENT DOCUMENTS 4,894,726 A * 1/1990 Steinhardt ..... H04N 1/4051 358/3.26
5,969,301 A * 10/1999 Cullum, Jr. ..... E04B 9/0464 181/295

(Continued)

*Primary Examiner* — Kevin R Kruer
(74) *Attorney, Agent, or Firm* — CALDWELL INTELLECTUAL PROPERTY LAW

(57) ABSTRACT

Microstructured surface development three dimensional form solutions that provide multiple functional benefits when applied to an object. Microstructured surface development three dimensional form solutions that provide efficiency gains to an object in dynamic motion in a fluid medium through aerodynamic/hydrodynamic skin friction drag reduction. Microstructured surface development three dimensional form solutions that additionally provide functional benefits to an object in a static, non-moving state as well as a dynamic state—namely super-hydrophobicity, light absorption, sound/radar absorption and heat dissipation. Microstructured surface development three dimensional form solutions that can be molded into the surface of an object. Microstructured surface development three dimensional form solutions that can be added to the surface of an object though a secondary forming operation (ie machining, laser engraving). Microstructured surface development three dimensional form solutions that can be attached to the surface of an object using an adhesive backed thin film that has been molded/cast with unique microstructured surfaces. Microstructured surface development three dimensional form solutions that are composed of unique tile-like individual elements that can be assembled as a unique continuous array on an object.

14 Claims, 19 Drawing Sheets

(56) References Cited

U.S. PATENT DOCUMENTS 6,213,252 B1 * 4/2001 Ducharme ..... E04F 15/20 181/294
7,258,731 B2 * 8/2007 D'Urso ..... C03C 17/30 428/323
10,006,085 B2 * 6/2018 Corn ..... C09D 5/00
11,428,942 B2 * 8/2022 Russell ..... G02F 1/133528
2002/0146540 A1 * 10/2002 Johnston ..... B01D 1/00 428/167
2005/0193675 A1 * 9/2005 Smart ..... E04B 5/02 52/578
2006/0024508 A1 * 2/2006 D'Urso ..... B05D 5/083 428/156
2006/0201318 A1 * 9/2006 LaBrash ..... F41H 5/023 89/36.02
2007/0018055 A1 * 1/2007 Schmidt ..... B64C 21/10 244/200
2008/0024292 A1 * 1/2008 Rosi ..... G09F 19/14 340/525
2011/0186685 A1 * 8/2011 Tsotsis ..... F15D 1/12 428/167
2011/0216411 A1 * 9/2011 Reed ..... G02B 5/124 359/530
2012/0088066 A1 * 4/2012 Aytug ..... C03C 17/00 216/37
2012/0088092 A1 * 4/2012 Simpson ..... B05D 5/08 428/323
2013/0125992 A1 * 5/2013 Krautschick ..... F17D 1/08 264/293
2013/0146217 A1 * 6/2013 Kray ..... F15D 1/003 156/210
2013/0156595 A1 * 6/2013 Sander ..... F01D 5/145 156/244.11
2013/0178130 A1 * 7/2013 Balint ..... E01C 5/00 29/897.3
2015/0083227 A1 * 3/2015 Bidkar ..... C09D 5/00 427/337
2015/0239773 A1 * 8/2015 Aytug ..... C03C 17/008 204/192.12
2016/0206018 A1 * 7/2016 Barbret ..... A41D 13/0053
2017/0045284 A1 * 2/2017 Meuler ..... B32B 7/12
2019/0023379 A1 * 1/2019 Okabayashi ..... F15D 1/12
2019/0134664 A1 * 5/2019 Rao ..... B05D 3/107
2020/0033097 A1 * 1/2020 Speyer ..... B32B 3/04
2021/0230882 A1 * 7/2021 Moller, Jr. ..... E04F 15/02161
2022/0203219 A1 * 6/2022 Dym ..... A63F 9/0669
2022/0267965 A1 * 8/2022 Welsh ..... E01C 5/02

* cited by examiner

MULTI-FUNCTIONAL MICROSTRUCTURED SURFACE DEVELOPMENT THREE DIMENSIONAL FORM SOLUTIONS IN INDIVIDUAL TILE AND MULTIPLE TILE ARRAY CONFIGURATIONS

RELATED APPLICATION

This application claims priority to U.S. provisional patent application No. 63/161,109 entitled "Multi Functional Microstructured Surface Development Form Solutions in Individual Tile and Multiple Tile Array Configurations" filed Mar. 15, 2021, the contents of which provisional application are incorporated herein by reference in their entirety.

BACKGROUND

It is known that the surface treatment of an object can affect the functional performance of said object—in both a static and dynamic manner. In a dynamic state, an object moving in a fluid medium (such as air, water) can be made more efficient through the incorporation of a microstructured surface treatment designed to reduce the effect of aero/hydrodynamic skin friction drag—which occurs just above the surface of an object moving dynamically in a fluid medium. Microstructured surface treatments are very small in size, and are barely visible to the naked eye, and are generally measured in microns due to their small size. In a static and dynamic state, the surfaces of an object can additionally be designed in such a way as to make said object incorporate super-hydrophobic properties—with the incorporation of a microstructured surface treatment, thus allowing the surfaces of the object to repel, or shed fluids (ie water). Still other beneficial functions can be designed into the surface treatment of an object through microstructured surface three dimensional form solutions—specifically light absorption, sound absorption, radar absorption and heat dissipation. It would thus be uniquely beneficial to have the ability to create surface treatment solutions for an object that incorporate the combined functional benefits of aero/hydrodynamic skin friction reduction, super hydrophobicity, and light/sound/radar absorption and heat dissipation. It would additionally be uniquely beneficial to have microstructured surface treatment solutions for an object that incorporate the multiple benefits described heretofore that can be formed into an objects surface through manufacture, or added as a secondary operation through the installation of microstructured surface three dimensional form solutions through an adhesively backed thin film onto an object.

DETAILED DESCRIPTION

Discussed herein is a unique and novel approach to the formation of multi-functional microstructured three dimensional surface form solutions that can be applied to the exterior surfaces of objects to increase said objects efficiency and functionality. The microstructured surface generation approach disclosed herein employs a consistent set of definable geometric characteristics, yet can yield multiple variations of microstructured surface solutions, as will be shown. For the purposes of this disclosure, the microstructured surface solutions discussed would have a maximum height value of 1 mm or less from the object they are applied to. Many of microstructured surface solutions discussed herein are significantly less than 1 mm in maximum height from the object they are applied to (0.15 mm height or less). The definable characteristics of the microstructured three dimensional forms disclosed herein are categorized in two distinct areas and will be described in detail. First, the microstructured three dimensional surface generation uniqueness of what is defined herein as the individual scale tile geometry. Second, the microstructured three dimensional surface generation uniqueness of what is defined herein as the scale tile array geometry. It is the combination of the unique individual scale tile geometry working in conjunction with the corresponding and related unique scale tile array orientation geometry, at an appropriate geometric scale, that yields unique and novel microstructured three dimensional surface form solutions which have unique and novel functional qualities that can be useful when applied to the exterior surfaces of objects.

Figure 1:
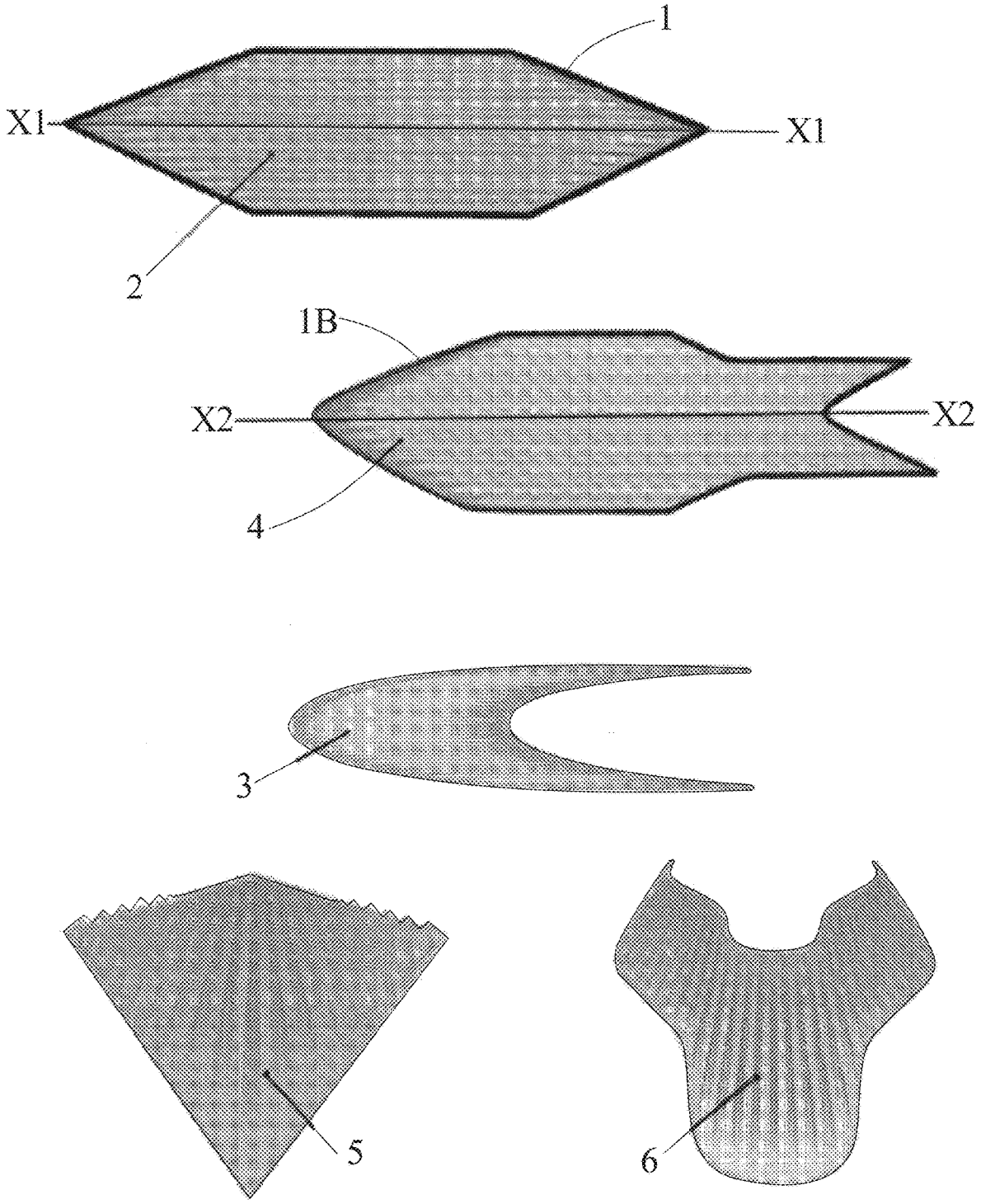
FIG. 1 illustrates multiple perimeter shapes in perspective views for individual scale tiles applied to a planar surface.

Microstructured Three Dimensional Surface Generation Uniqueness of the Individual Scale Tile Geometry:

Referring to the drawings, FIG. 1 Illustrates multiple perimeter shapes of individual scale tiles 2,3,4,5 and 6 shown in perspective views for individual scale tiles applied to a planar surface. A substantially hexagon individual scale tile shape 2 is shown with symmetry along axis X1 and X4. The perimeter defining the outer boundary of the hexagon perimeter shape 1 is also illustrated. Also shown in FIG. 1 is a unique individual scale shape 4 which has symmetry along axis X2 only. The outer boundary perimeter 1B is shown for individual scale tile shape 4. It should be apparent to those skilled in the art that additional individual scale tile shapes can be generated within the constraints defined in FIG. 1. Additionally, the individual scale tile shapes 2,3,4,5 and 6 are shown as generated on a planar surface, and those skilled in the art would understand that the individual scale tile shapes described in FIG. 1 can be applied to 3 dimensional volumetric shapes as well as planar shapes.

Figure 2A:
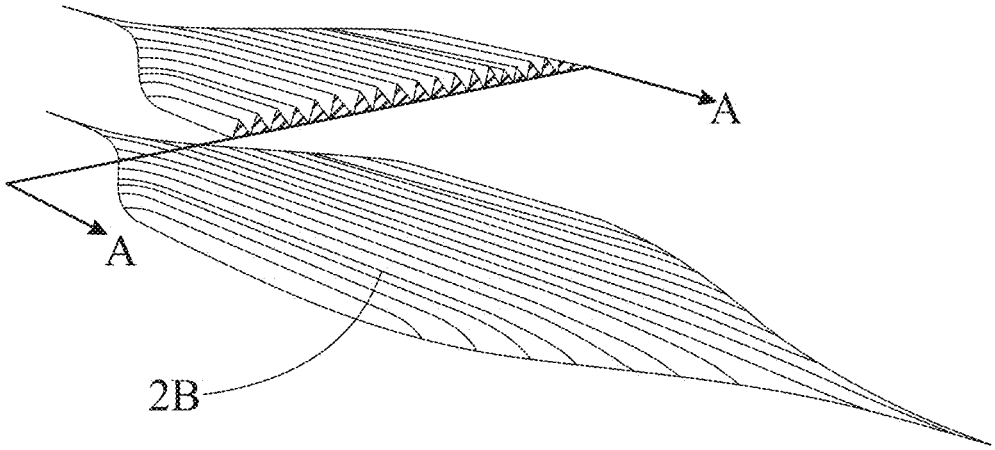
FIG. 2 illustrates the transverse section geometry of two types of individual scale tiles on a planar surface.
Figure 2B:
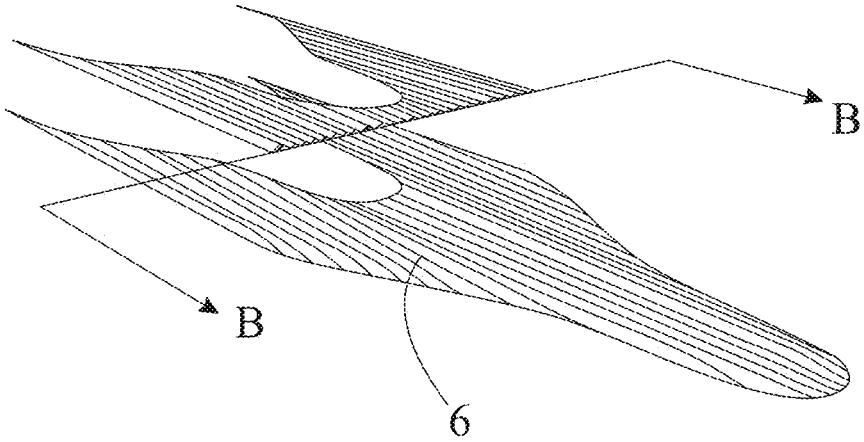
Figure 2C:
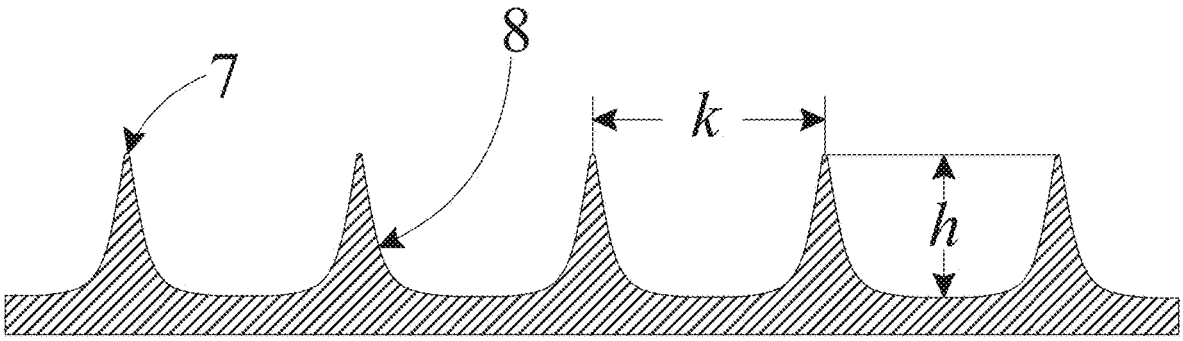

FIG. 2 shows two perspective views of individual scale tiles 6, 2B applied to a planar surface. The perspective views of the individual scale tiles describe a transverse section taken through the approximate mid point of the individual scale tiles, shown as section A through individual scale tile 6, and section B through individual scale tile 2B. Also shown in FIG. 2 is a transverse section view detail of an individual scale tile. Illustrated in FIG. 2 are surface peaks 7 which occur at a height h, and surface depressions 8 which occur in transition along the entirety of length k. The transverse sections and section detail shown in FIG. 2 are typical along the longitudinal length of individual scale tiles 6, 2B, where only the height h between the individual peaks 7 can vary.

Figure 3A:
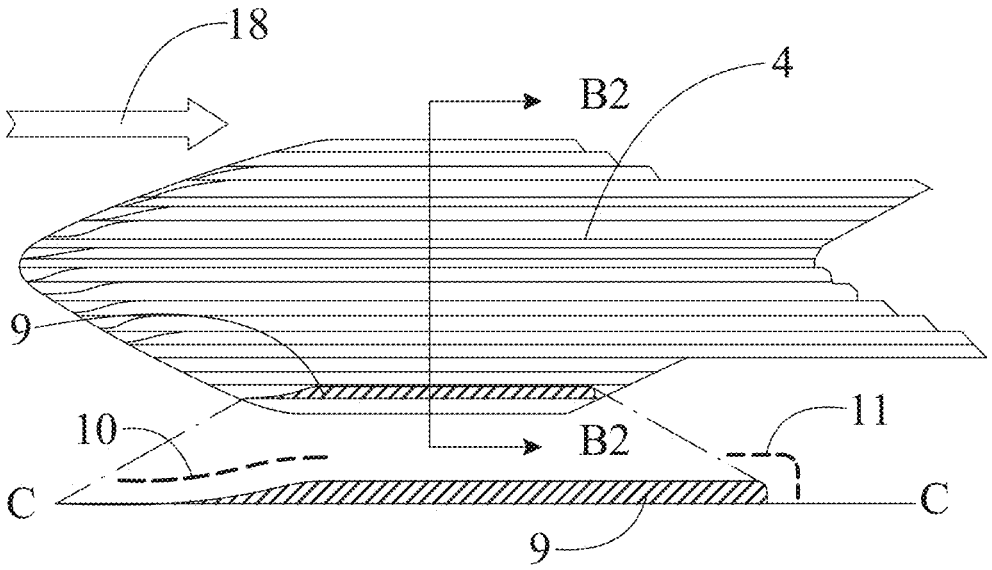
FIG. 3A is a perspective view of an individual scale tile. Also shown is a longitudinal section view of an individual raised surface riblet that is part of the surface geometry of an individual scale tile.

FIG. 3A shows an individual scale tile 4 applied to a planar surface. The individual scale tile is made up of a finite amount of raised longitudinal surfaces 9 hereafter referred to in this disclosure as 'riblets'. Section C is shown, which travels through the raised riblet surface 9 in a longitudinal orientation. Also shown in section C is the leading edge curve profile 10 and the trailing edge curve profile 11. The section curve profiles 10, 11 have the characteristics of an OG curve line, defined as a double curve resembling an 'S'—formed by the union of a convex and a concave line. The utilization of an OG curve for the leading and trailing curve profiles 10, 11 allows for a gradual transition to the maximum height of a raised riblet surface 9, and a transition back to the lowest point in section C. Those skilled in the art would understand that OG curves can have different curve profiles than shown in curve profiles 10, 11.

Figure 3B:
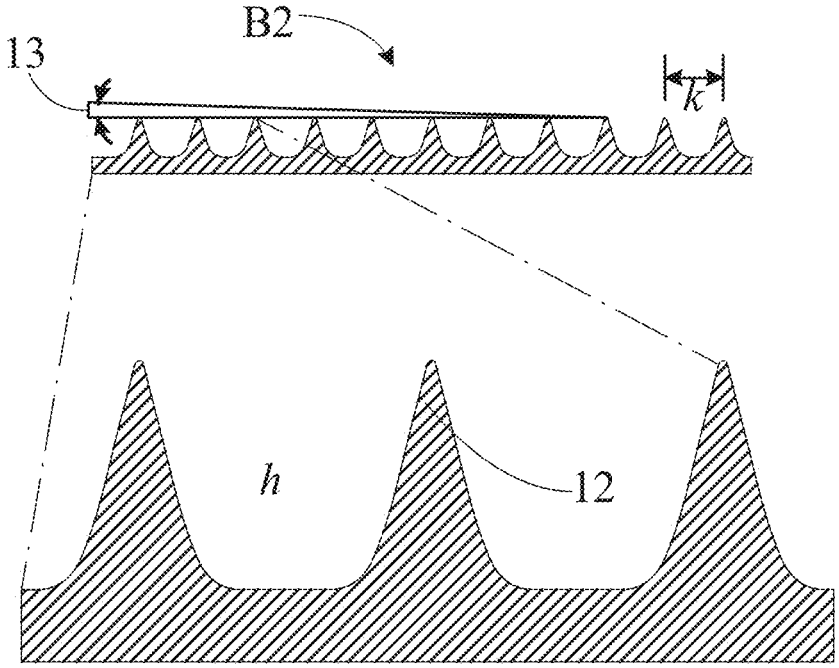
FIG. 3B contains detailed transverse section views B of the longitudinal riblets that are part of the surface geometry of an individual scale tile.

FIG. 3B shows images that further illustrate the transverse section B2 of the longitudinal riblets 9 that are part of the surface geometry of an individual scale tile. The riblet section geometry is shown at a height h, and at a spacing k between the riblets. Riblet height h has been shown to be most effective at a maximum height of 0.15 mm or less, with a spacing k of 1.5 times the length of h. It should be apparent though to those skilled in the art that a proportional increase or decrease in the values of h, k simultaneously would result in individual scale tiles of a larger or smaller size which broadens the useful application range of the individual scale tiles. It is also shown that the individual riblet section geometry lies within an angle 12 from the surface peaks 7 throughout the riblet height h to it's lowest point on section B2. An angle 13 is also shown, which all the peak riblet section geometry falls under, from the central point of the individual scale tile section to the outermost point of the section. The angle 13 can be of various values, however the presence of a definable angle 13 shows the height h for the individual riblet section geometry becomes smaller in value from the central point of the individual scale tile section to the outermost point of the section. It can be assumed that if the definable angle 13 is of a zero value, then the heights h for each longitudinal riblet are the of the same value. Experimentation has shown that a smaller value numerically for angle 12 has a positive outcome in the performance of the microstructured surfaces, and an angle 12 at a value of 15 degrees from the vertical or less is preferable.

Figure 4:
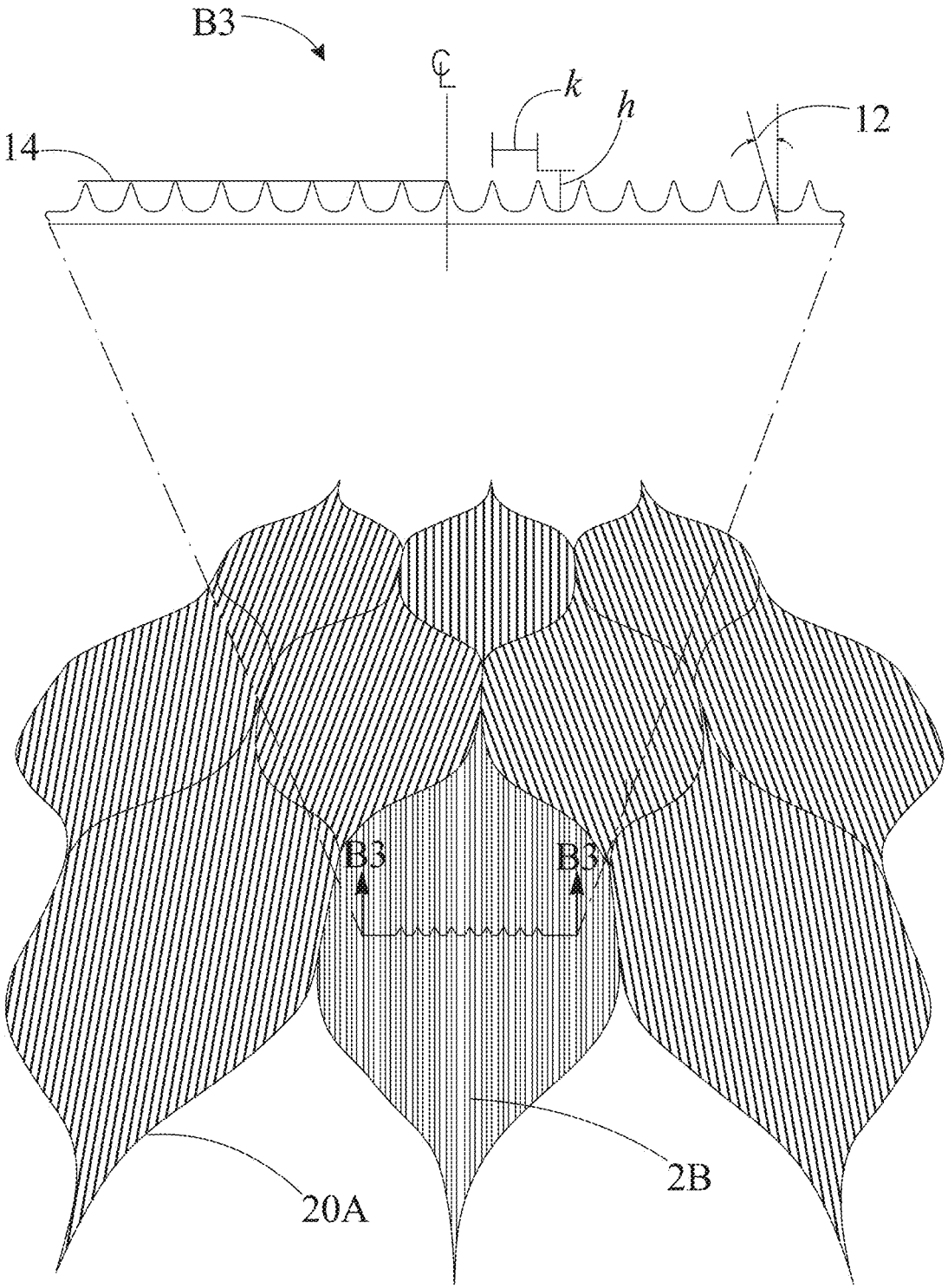
FIG. 4 contains a perspective view of multiple scale tiles, and also a transverse section of an individual scale tile on a planar surface.

FIG. 4 shows a scale tile array 20A composed of individual scale tiles 2B applied to a planar surface. Section B3 is a transverse section taken through an individual scale tile 2B. Illustrated in Section B3 is a transverse section of individual scale tile 2B, with riblets of height h and spacing k. Also shown is the angle 12 formed from the vertical where the riblet section geometry falls within, which has been shown to be most effective experimentally at 15 deg or less, and common among all riblets shown in Section B3. A horizontal line 14 is shown, which all riblets shown in Section B3 fall below. This illustrates that the riblet heights h can have a tapering value, from the center of Section B3 out to the ends of Section B3. Additionally It should be apparent to those skilled in the art that a proportional increase or decrease in the values of h, k simultaneously would result in individual scale tiles of a larger or smaller size which broadens the useful application range of the individual scale tiles.

Figure 5:
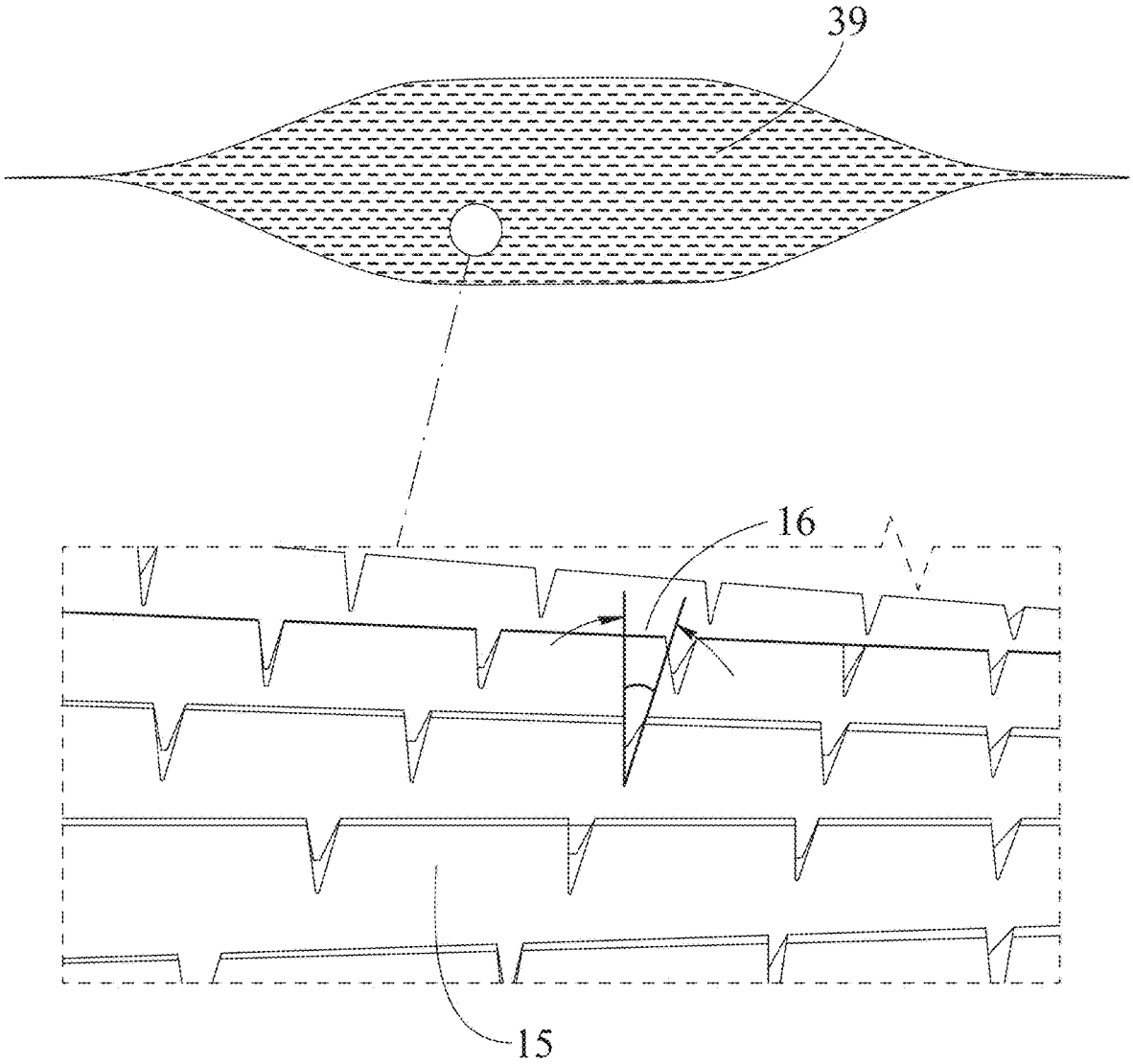
FIG. 5 shows multiple perspective views of an individual scale tile. The individual scale tile shown in the drawings shows a variation in the longitudinal riblets where the riblets have multiple bisections of similar geometry along their length.

FIG. 5 shows an additional embodiment of an individual scale tile 2C. Riblets of a finite length 15 are shown, with bisecting elements 16 that interrupt the riblet 15 longitudinal geometry multiple times along the length of each riblet. The bisecting elements form an angle of at least 30 deg for each instance along the longitudinal riblet length for each riblet that makes up the individual scale tile.

Figure 6:
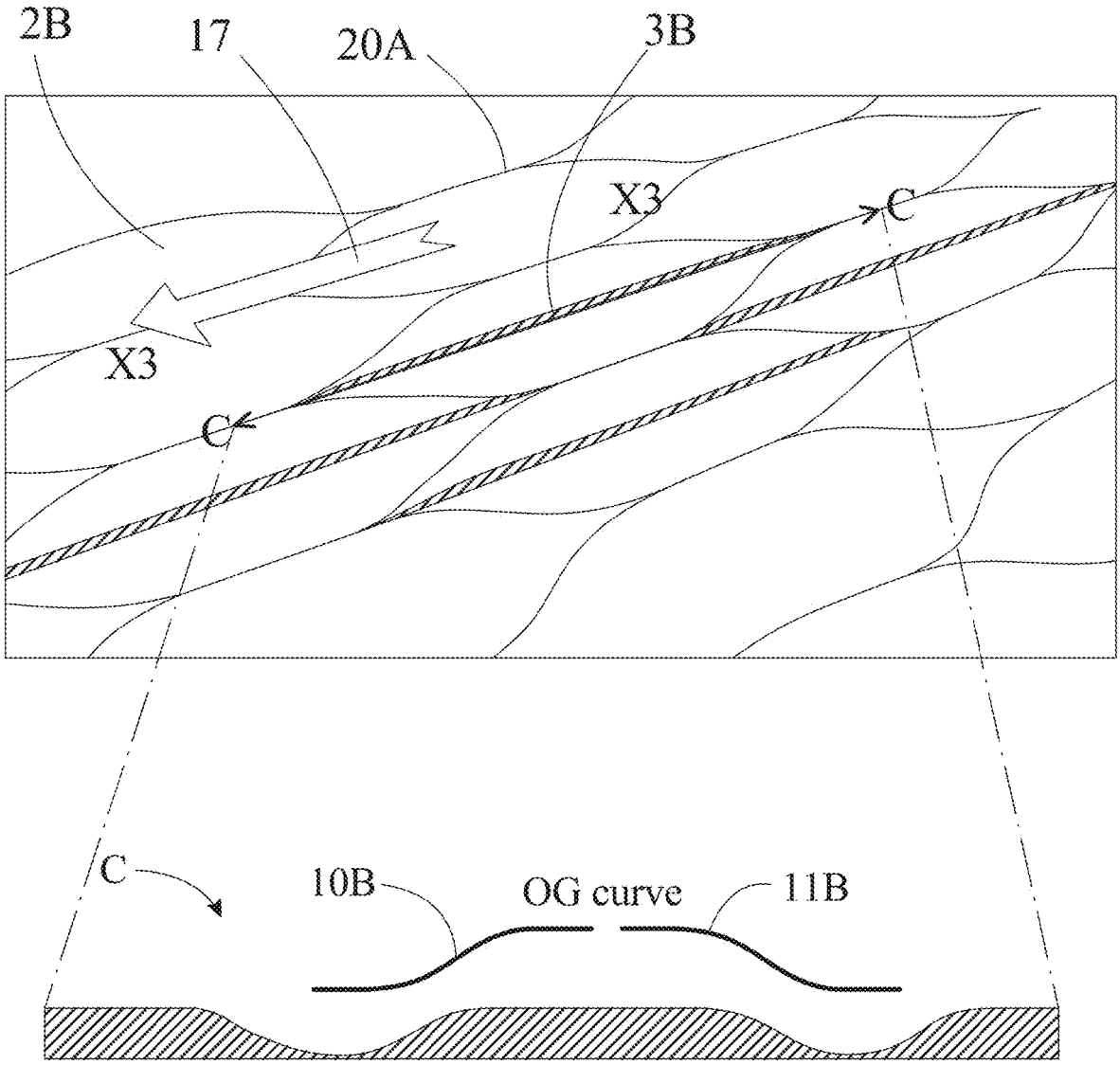
FIG. 6 is a perspective view of a multiple scale tile array configuration on a planar surface. Also shown is a longitudinal section of the scale array through the raised surface riblets detailing the transition between riblets from different individual scale tiles.

Microstructured Three Dimensional Surface Generation Uniqueness of the Scale Tile Array Geometry:

FIG. 6 shows a scale tile array 20A in perspective view. Also shown is the bi-directional fluid flow 17 (ie air, water) along axis X3. The longitudinal section C is shown on multiple individual scale tile elements 2B. Also shown in section C is the leading edge curve profile 10B and the trailing edge curve profile 11B, which are equivalent but symmetrical as 10B defines the leading edge, and 11B defines the trailing edge of longitudinal riblet 9B in section C. The section curve profiles 10B, 11B have the characteristics of an OG curve line, defined as a double curve resembling an 'S'—formed by the union of a convex and a concave line. The utilization of an OG curve for the leading and trailing curve profiles 10B, 11B allows for a gradual transition to the maximum height of a raised riblet surface 9, and a transition back to the lowest point in section C. Those skilled in the art would understand that OG curves can have different curve profiles than shown in curve profiles 10B, 11B.

Figure 7:
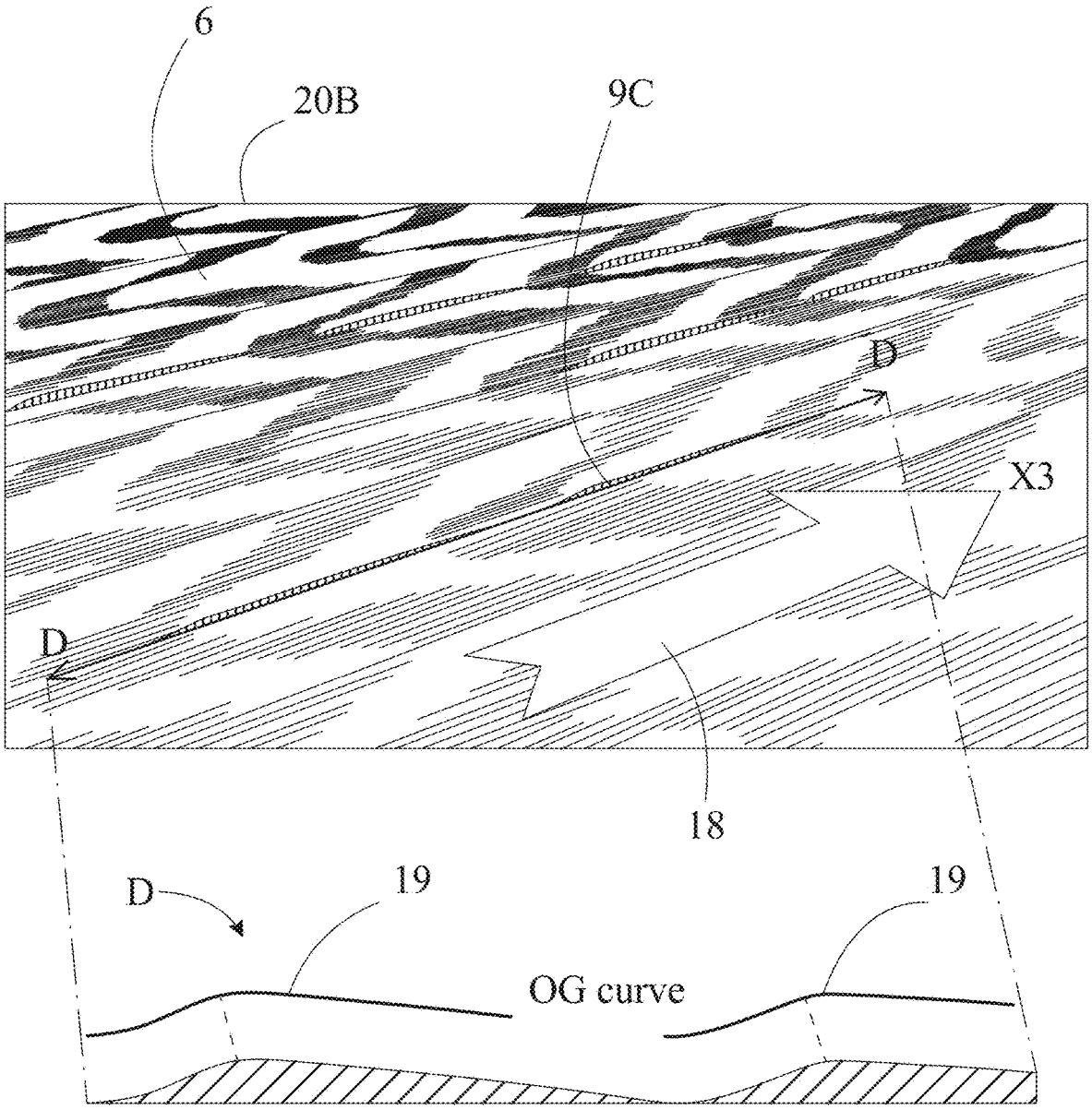
FIG. 7 is a perspective view of a multiple scale tile array configuration on a planar surface. Also shown is a longitudinal section of the scale array through the raised surface riblets detailing the transition between riblets from different individual scale tiles.

FIG. 7 is an additional embodiment of a scale tile array 20B in perspective view. Also shown is uni-directional fluid flow 18 (ie air, water) along axis X3. The longitudinal section D is shown on multiple individual scale tile elements 6. Also shown in section D is the leading and trailing edge curve profile 19. The section curve profile 19 has the characteristics of an OG curve line on both ends, defined as a double curve resembling an 'S'—formed by the union of a convex and a concave line. The utilization of an OG curve for both ends of the line 19 allows for a gradual transition to the maximum height of a raised riblet surface 9, and a transition back to the lowest point in section D. Those skilled in the art would understand that OG curves can have a different curve profile than the one shown in curve profile 19.

Figure 8:
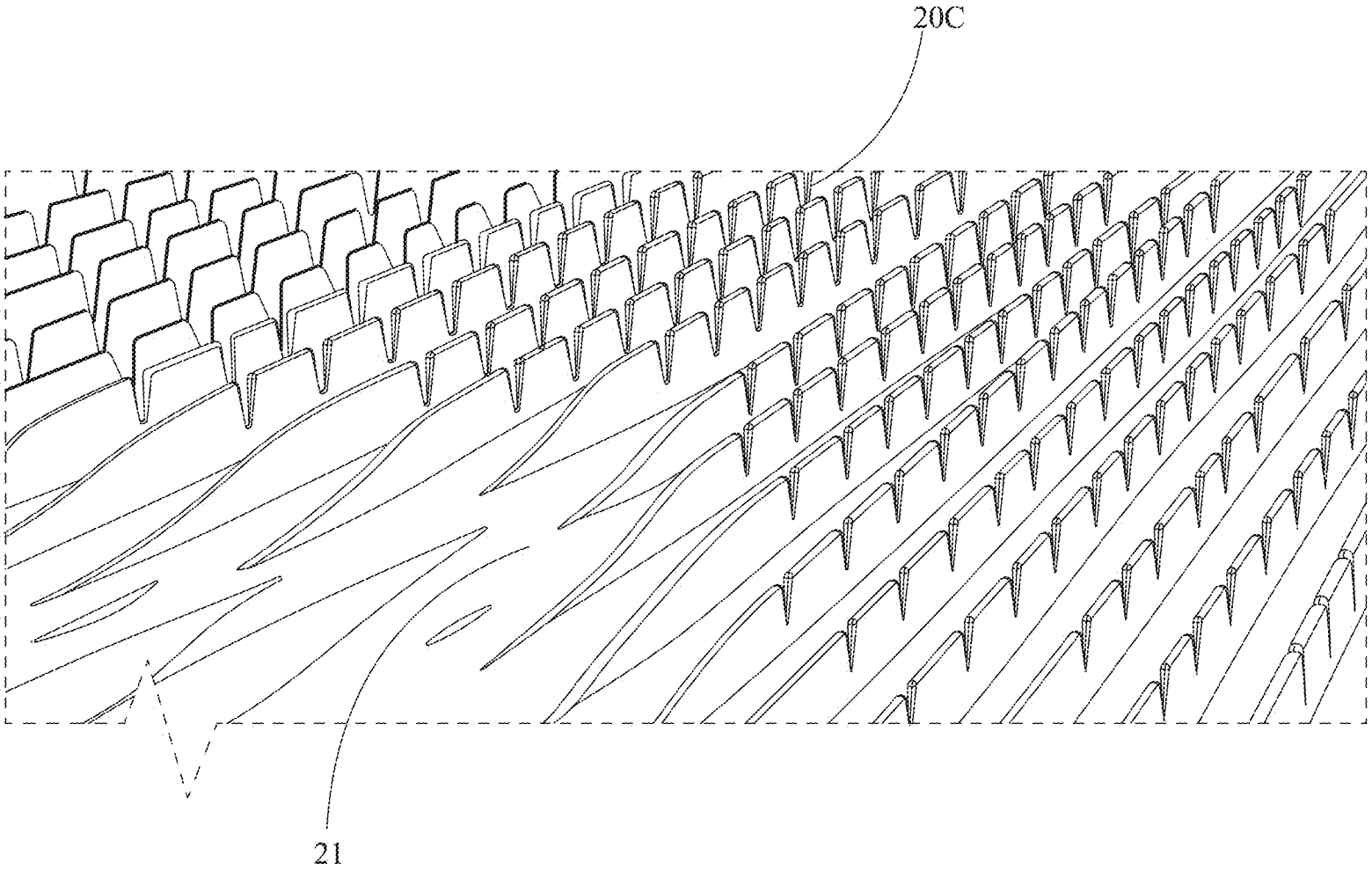
FIG. 8 is a perspective view of a multiple scale tile array configuration on a planar surface. Also shown is the transition between individual scale tiles that make up the scale tile array.
Figure 9B:
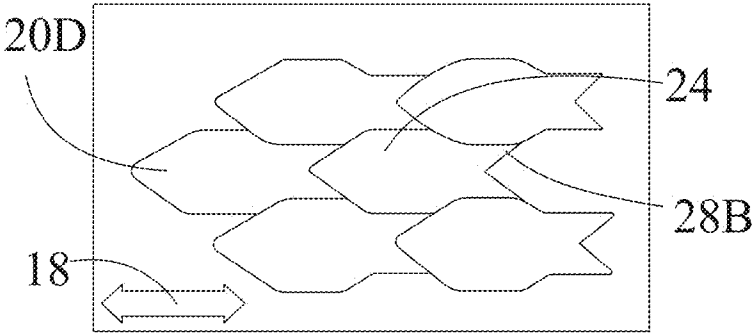
FIG. 9 Illustrates multiple scale tile array configurations on a planar surface composed of multiple unique individual scale tiles in perspective views.
Figure 9A:
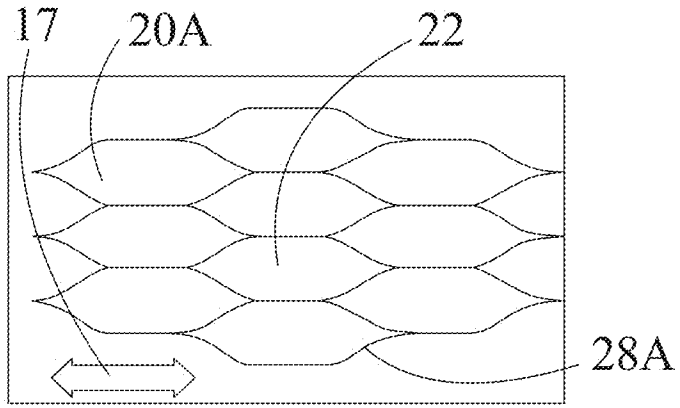
Figure 9D:
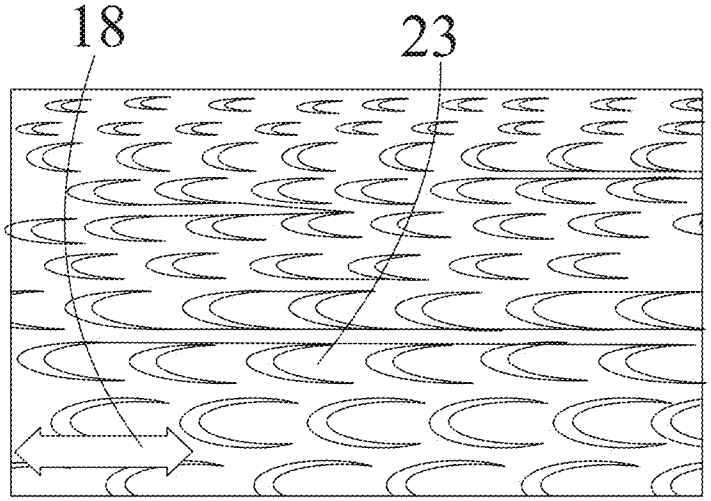
Figure 9C:
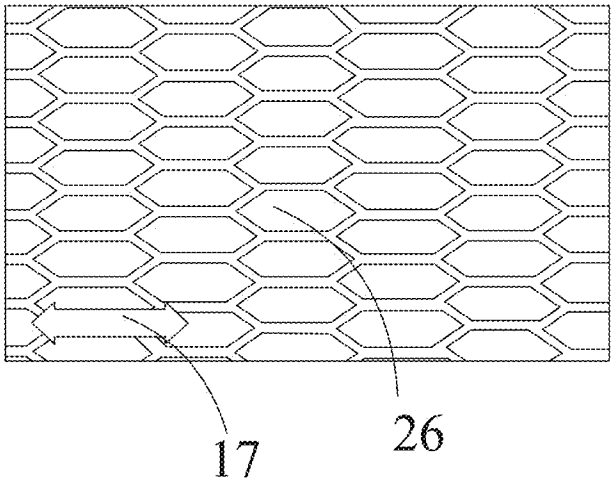
Figure 9F:
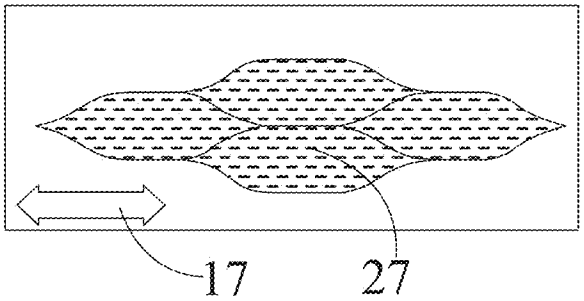
Figure 9E:
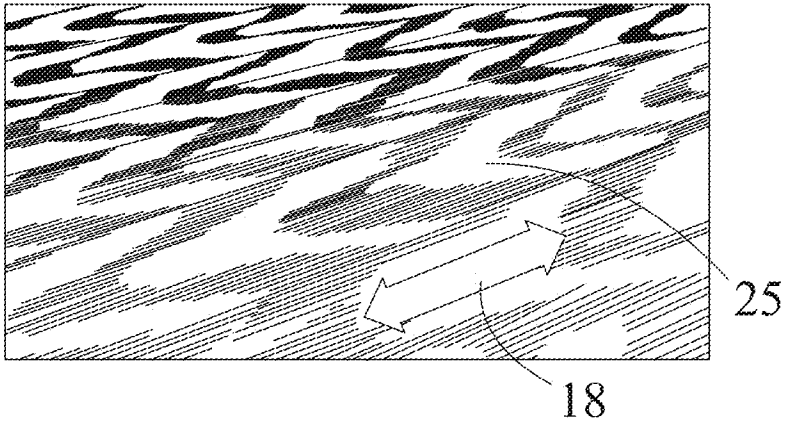

FIG. 8 is an additional embodiment of a multiple scale tile array configuration 20C applied to a planar surface in perspective view. Shown is the substantially flat transition area 21 between the individual scale tiles that make up the scale tile array 20C. The transition area 21 is formed at intersection of the leading and trailing edges of the riblet surfaces that make up the individual scale tiles that in turn make up the scale tile array 20C. Those skilled in the art would understand that the transition area 21 between the individual scale tiles that in turn make up the scale tile array can have multiple geometric outcomes while staying consistent to the defining criteria described herein.

FIG. 9 shows multiple scale tile array configurations on a planar surface 22, 23, 24, 25, 26, 27 that are each composed of a finite number of individual scale tiles of similar geometry which make up each unique scale tile array. Scale array configurations 23, 24, 25 are surface solutions applicable to dynamic flow environments that are unidirectional and depicted by direction arrow 18. Scale array configurations 22, 26, 27 are surface solutions applicable to bi-directional flow dynamic environments and depicted by direction arrow 17. Also shown in FIG. 9 is a linear depiction 28A of the orientation of the multiple individual scale tiles 20A that make up the scale tile array 22. The linear depiction 28A clearly describes the unique orientation of the individual scale tiles that make up the scale tile array for the individual scale tiles used in bidirectional flow 17 and have symmetry along two axis. A linear depiction 28B of the orientation of the multiple individual scale tiles 20D that make up the scale tile array 22 is also shown. The linear depiction 28B clearly describes the unique orientation of the individual scale tiles that make up the scale tile array for individual scale tiles used in unidirectional flow 18 and have symmetry along one axis. Those skilled in the art would understand that the scale tile arrays shown can be of multiple sizes and contain various numbers of individual scale tiles making up the scale tile arrays, on both planar surfaces and on three dimensional volumetric shapes.

Figure 10A:
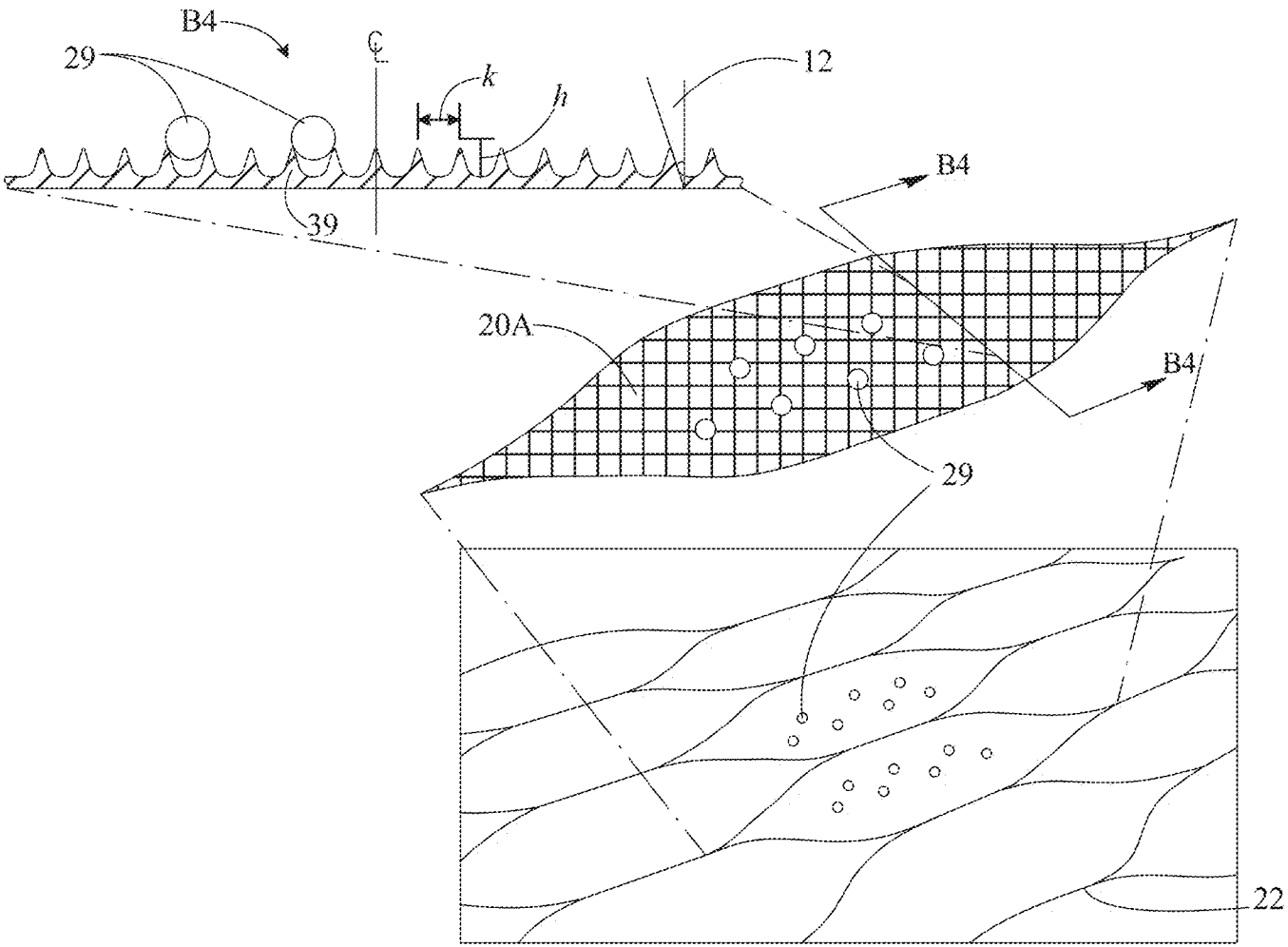
FIG. 10A has multiple views that describe the ability of microstructured three dimensional form surface solutions of a uniquely defined overall geometry to possess super-hydrophobic characteristics. Shown are individual scale tiles, scale tile arrays, and section views of individual scale tiles on planar surfaces.

Uniqueness in Providing Multi Functional Performance Benefits:

FIG. 10A shows an individual scale tile 20A and a corresponding scale tile array 22 in perspective view. A transverse section B4 is taken through individual scale tile 20A, and shown in the section geometry are the riblet profiles 39 that make up the transverse section B4. Also shown in section B4 is the angle 12 formed from the vertical that the riblet section geometry falls within, which has been shown to be most effective experimentally at 15 deg or less, and common among all riblets shown in Section B4. A spherical water droplet 29 is shown in section B4, where it is tangent at two places on the riblet profile 39. Spherical water droplets are also shown on the individual scale tile and the scale tile array in perspective view.

Figure 10B:
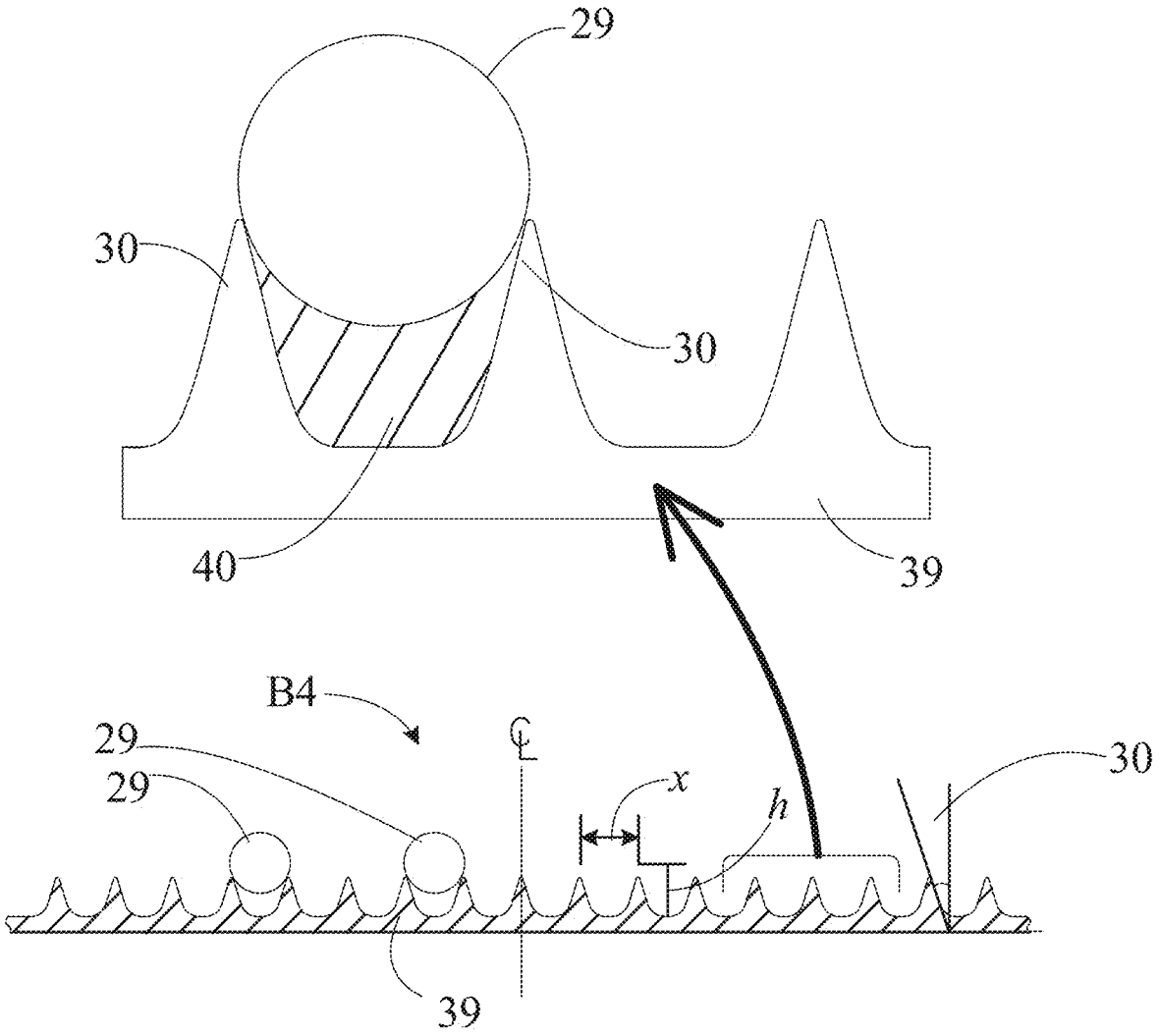
FIG. 10B is a further illustration of section B4 which details the ability of microstructured three dimensional form surface solutions of a uniquely defined overall geometry to possess super hydrophobic characteristics.

FIG. 10B is a further detail of section B4 which describes the ability of the riblet profile 39 to suspend water droplets of a particular diameter that correspond to a related geometry of the riblet profile 39. FIG. 10B illustrates a water droplet 29 that is tangent at two places on the riblet profile 39. A contact angle 30 is shown, where the angle 30 measures 15 degrees from the vertical or less. Shown below the water droplet is an air gap 40 formed by the suspension of the water droplet above the lower portion of the riblet profile 39. This description of a water droplet 29 being suspended by riblet profile 39 with a contact angle of 15 degrees or less, creating an air gap 40 between the water droplet and the lower portion of the riblet profile 39 can be categorized as super hydrophobic—and have the ability to shed water. It should also be understood by those skilled in the art that the proportional size of the microstructured surface solution employed will directly affect the capabilities of the surface solution to shed water, and thus affect the degree to which the microstructured surface solution is considered super hydrophobic. Super hydrophobicity can be a unique and useful characteristic of an object surface, dependent on the use and application of the object.

Figure 11A:
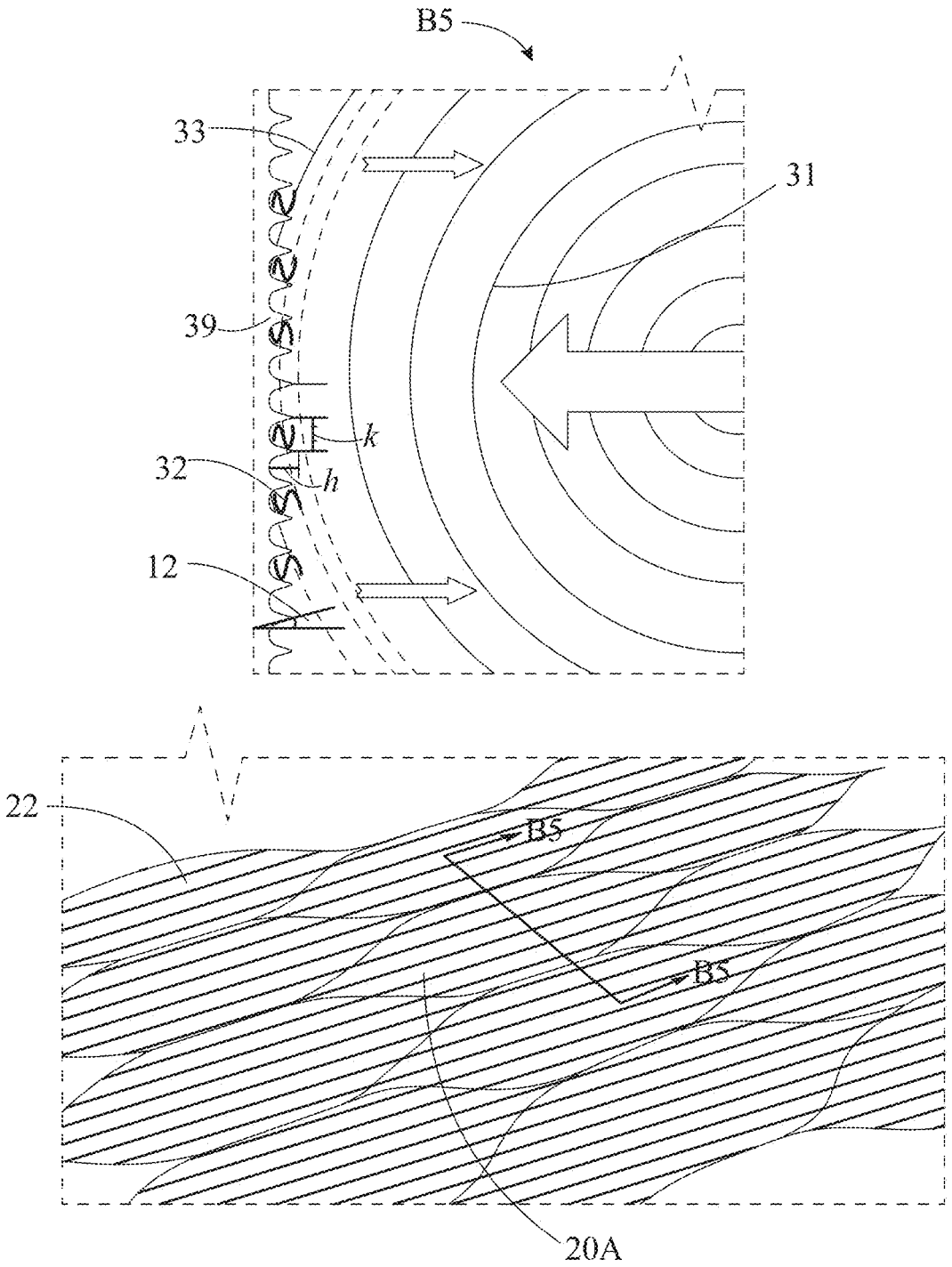
FIG. 11A has multiple illustrations that describe the ability of microstructured three dimensional form surface solutions of a uniquely defined overall geometry to possess sound and radar absorbing characteristics. Shown are individual scale tiles, scale tile arrays, and section views of individual scale tiles on planar surfaces.

FIG. 11A shows an individual scale tile 20A and a corresponding scale tile array 22 in perspective view. A transverse section B5 is taken through individual scale tile 20A, and shown in the section geometry detail of the riblet profiles 39 that make up the transverse section B5. Also shown in section B5 is the angle 12 formed from the vertical where the riblet section geometry falls within, which has been shown to be most effective experimentally at 15 deg or less, and common among all riblets shown in Section B5. Waves 31 are shown directed at the riblet section geometry, where reflected waves 33 are shown, as well as absorbed waves 32. The waves 31 illustrated are representative of sound, radar and sonar waves. The description of waves 31 being partially or fully absorbed by the riblet section geometry 39 can be a unique and useful characteristic of an object surface, dependent on the use and application of the object. It should also be understood by those skilled in the art that the proportional size of the microstructured surface solution employed will directly affect the capabilities of the surface solution to absorb waves 31.

Figure 11B:
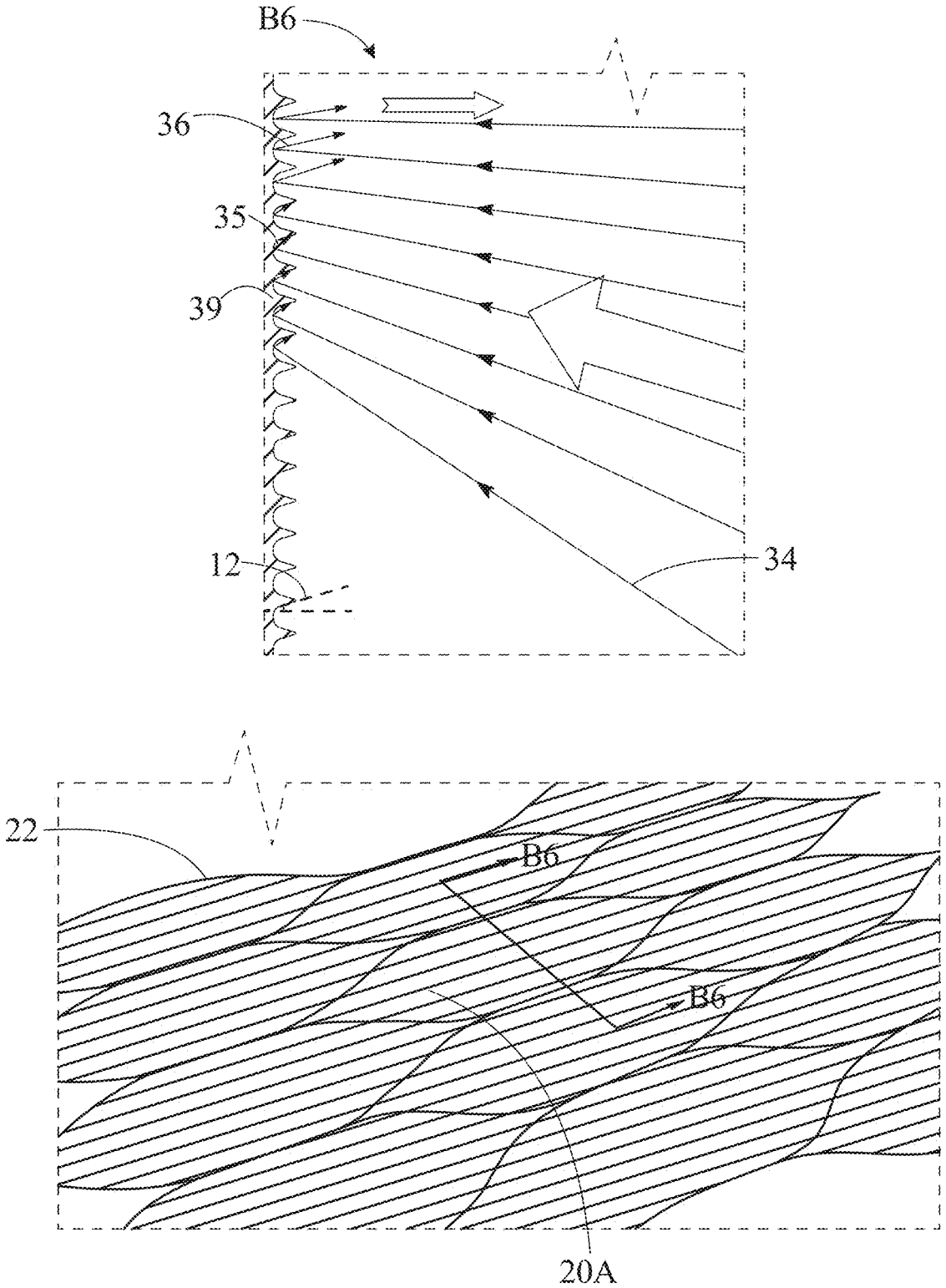
FIG. 11B has multiple illustrations that describe the ability of microstructured three dimensional form surface solutions of a uniquely defined overall geometry to possess light absorbing characteristics. Shown are individual scale tiles, scale tile arrays, and section views of individual scale tiles on planar surfaces.

FIG. 11B shows a transverse section B6 is taken through individual scale tile 20A, and a corresponding scale tile array 22 in perspective view. Shown in the section B6 is the geometry detail of the riblet profiles 39 that make up the transverse section B6. Also shown in section B6 is the angle 12 formed from the vertical where the riblet section geometry falls within, which has been shown to be most effective experimentally at 15 deg or less, and common among all riblets shown in Section B6. Also shown in FIG. 11B are incident light rays 34, reflected light rays 36, and absorbed light rays 35. The description of incident light rays 34 being partially or fully absorbed by the riblet section geometry 39 can be a unique and useful characteristic of an object surface, dependent on the the use and application of the object. It should also be understood by those skilled in the art that the proportional size of the microstructured surface solution employed will directly affect the capabilities of the surface solution to absorb incident light rays.

Figure 12:
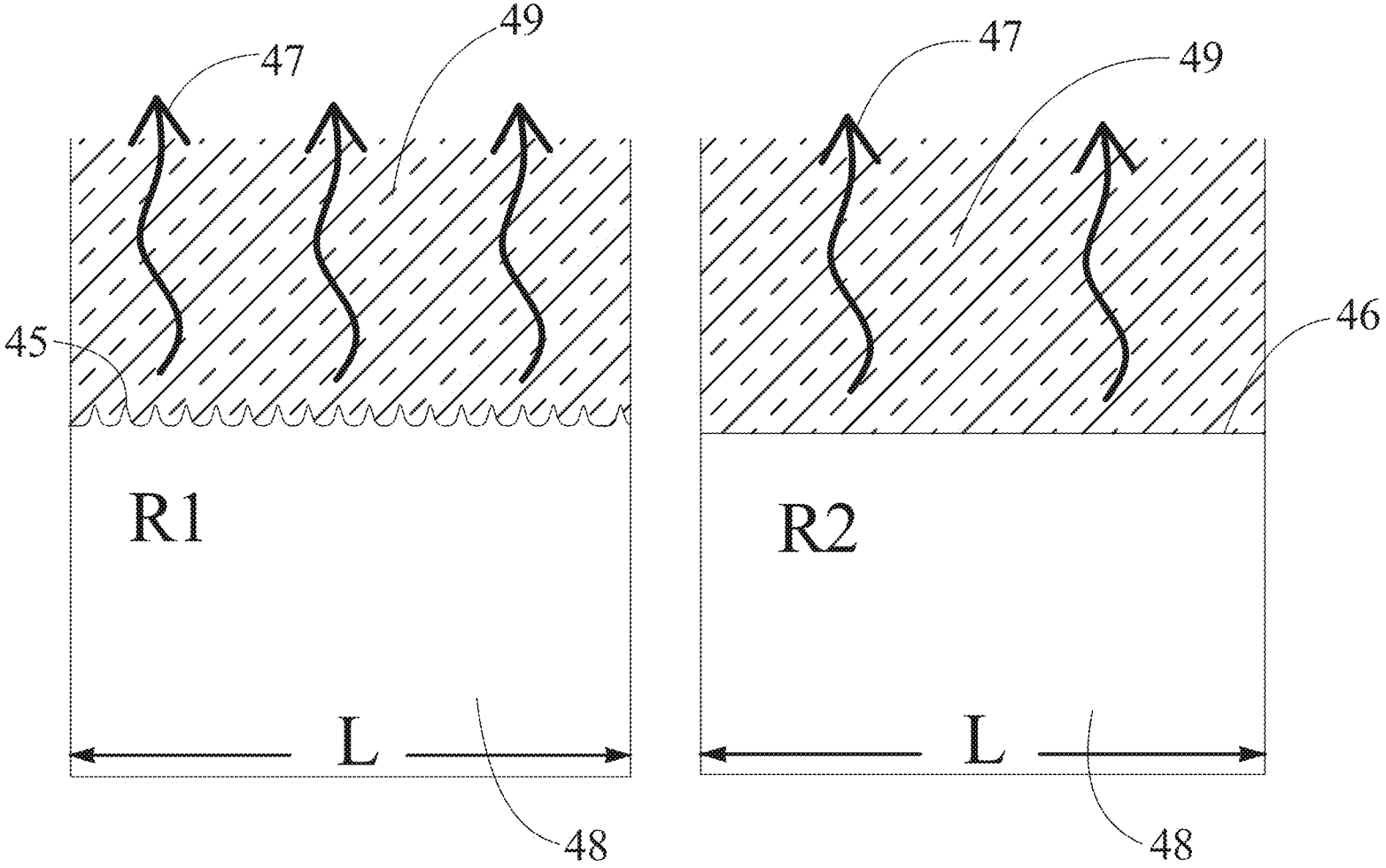
FIG. 12 describes the ability of microstructured three dimensional form surface solutions of a uniquely defined overall geometry to possess heat dissipation characteristics. Shown is a transverse section of an individual scale tile compared with a transverse section that is flat with no additional defining geometry.

FIG. 12 shows a typical transverse section of a portion of an individual scale tile R1 composed of a solid conductive material 48. Also shown is section R2, composed of an equivalent solid material 48. The scale tile section R1 has a corresponding surface boundary line 45, and section R2 has a corresponding boundary line 46. Also shown in sections R1 and R2 is that they have equal lengths L. A fluid area 49 such as air is shown adjacent to sections R1, R2. Heat dissipation lines 47 are depicted in both sections R1, R2, showing heat moving from solid 48 to fluid 49. Since the surface boundary line 45 equivalent length for R1 is significantly greater than the surface boundary line 46 equivalent length, it can be concluded that the section R1 would be superior in heat extraction, assuming all other defining characteristics are equal. The description of superior heat dissipation from the surface of an object made of a conductive solid material can be a unique and useful characteristic of an object surface, dependent on the use and application of the object. It should also be understood by those skilled in the art that the proportional size of the microstructured surface solution employed will directly affect the capabilities of the surface solution to dissipate heat from the conductive surface of an object.

Figure 13A:
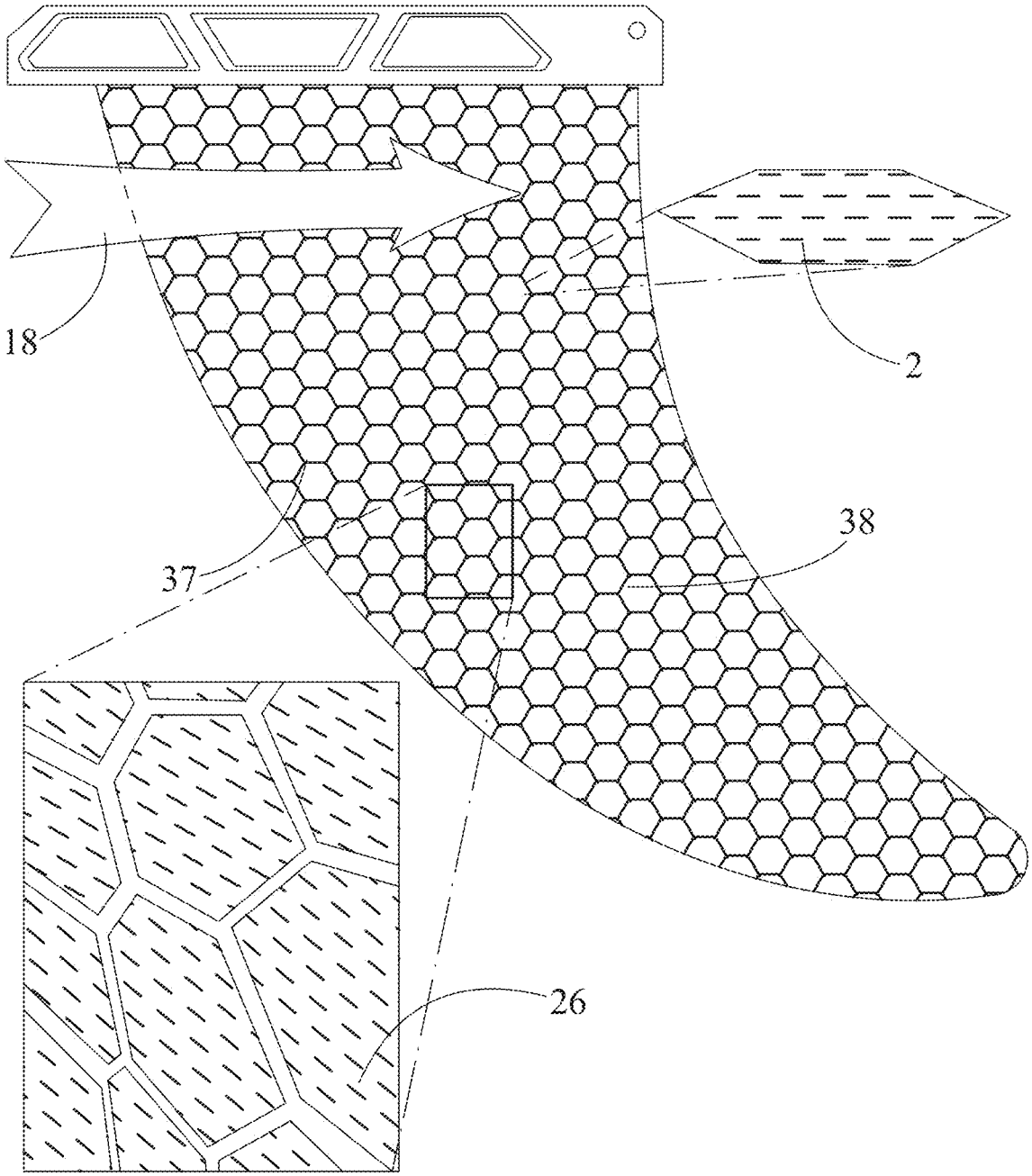
FIG. 13A describes the ability of microstructured three dimensional form surface solutions of a uniquely defined overall geometry applied to a novel product for the purpose of increasing the dynamic efficiency of said product. Shown are individual scale tiles, scale tile arrays, and the application on the novel product surface exterior of the scale tile arrays on a compound surface.

FIG. 13A describes an example application of a microstructured three dimensional surface form solution of a uniquely defined geometry applied to a novel product 37 for the purpose of increasing the dynamic efficiency and functionality of said product. Shown is an individual scale tile 2, a scale tile array 26, and the application on the novel product surface exterior of the scale tile array on a compound volumetric surface 38. Flow direction 18 is also shown. Potential benefits that can be realized by the application of microstuctured three dimensional form solutions as discussed within this disclosure include any combination of the following unique and novel characteristics: aero/hydrodynamic skin friction drag reduction, super hydrophobicity, wave absorption, light absorption, heat dissipation.

Figure 13B:
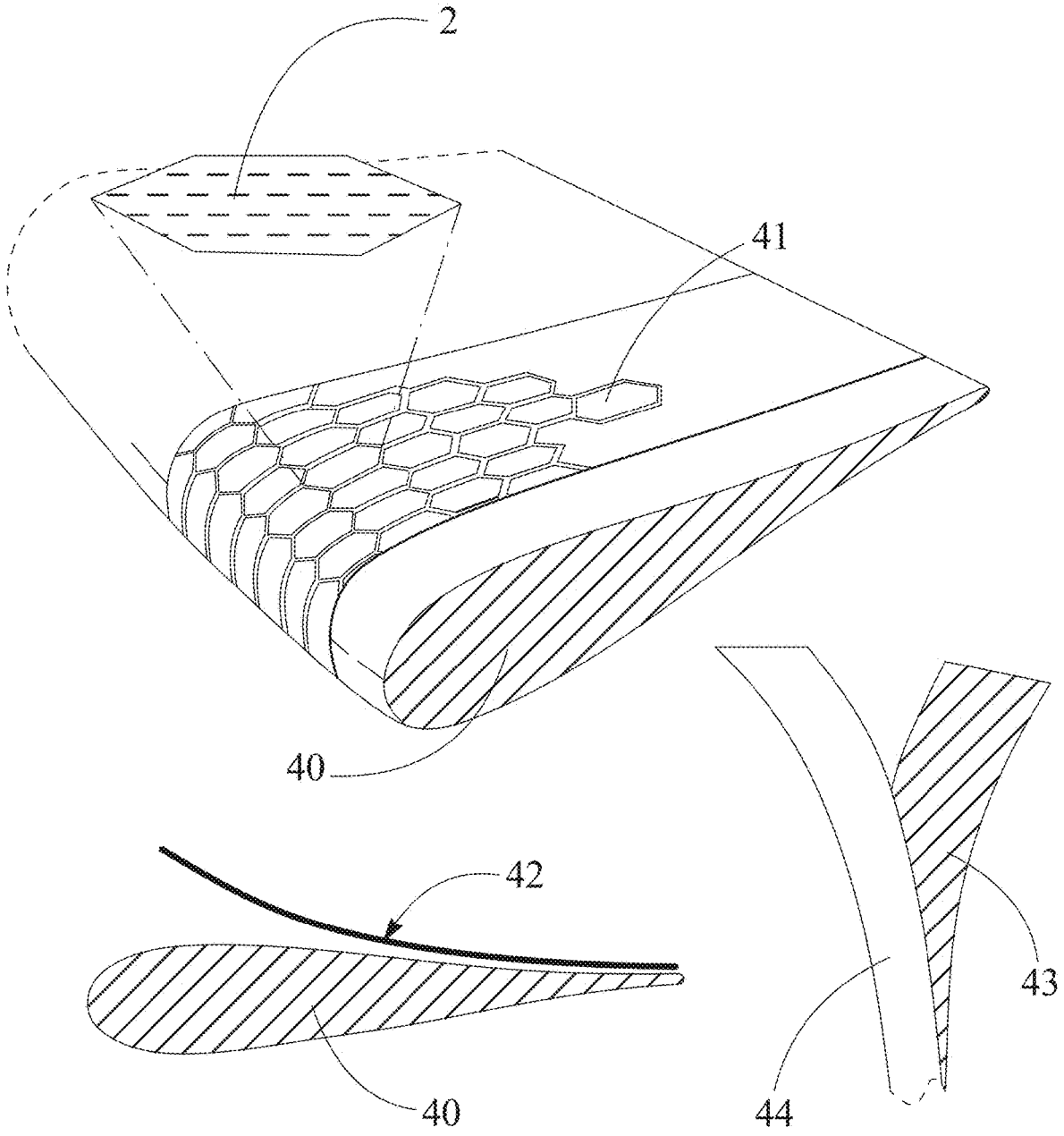
FIG. 13B Describes the attachment onto a novel product of a thin film with a microstructured three dimensional form solution molded into the film, with an adhesive backing that allows installation onto the novel product. Shown are individual scale tiles, scale tile arrays, and the application on the novel product surface exterior of the scale tile arrays on a compound surface.

FIG. 13B describes an example application of microstructured three dimensional surface form solutions of a uniquely defined geometry applied to a novel product 40 for the purpose of increasing the dynamic efficiency and functionality of said product. Detailed in FIG. 13B is a method of applying a scale array surface sheet 41 that is composed of individual scale tiles 2 that have been formed through molding onto a continuous length thin film sheet made of a plastic material such as polyethlyene. The thin film sheet 41 has a formed scale tile array surface 42 on one side, and an adhesive backing 43 on the reverse side, which allows for installation onto the novel product 40. The scale array thin film sheet 41 has a backing material 44 that can be removed before the installation of the scale array thin film sheet 41 on to novel product 40. It can also be stated that other processes can be used to create the microstructured three dimensional surface form solutions on novel objects representative to those disclosed herein. Methods such as molding, casting, roll forming, and secondary machining are examples of processes that could be employed to achieve the disclosed microstructured three dimensional surface form solutions on novel objects. Potential benefits that can be realized by the application of the microstructured three dimensional form solutions as discussed within this disclosure include any combination of the following unique and novel characteristics: aero/hydrodynamic skin friction drag reduction, super hydrophobicity, wave absorption, light absorption, heat dissipation.

The invention claimed is:

1. A multi-functional microstructured tile, comprising:

a perimeter having a predetermined shape, wherein the perimeter has a transverse axis extending in a transverse direction and a longitudinal axis extending in a longitudinal direction, wherein the perimeter is symmetric about at least one of the transverse axis and the longitudinal axis, and wherein the perimeter has a first side and a second side spaced from the first side in the transverse direction;

a substantially flat base within the perimeter, wherein a third axis extends in a third direction away from the base and is substantially perpendicular to both the transverse axis and the longitudinal axis;

a plurality of microstructures formed within the perimeter and on the base, the plurality of microstructures comprising:

a plurality of riblets extending in the longitudinal direction; and a plurality of recesses extending in the longitudinal direction and spacing each riblet of the plurality of riblets;

wherein:

each riblet of the plurality of riblets comprises a predetermined shape along a transverse cross section and extends in the third direction to form a peak;

each riblet of the plurality of riblets has multiple bisections along the length of the riblet;

a height of the peaks of riblets decreases in the transverse direction from a central axis of the tile to the first side and from the central axis of the tile to the second side, wherein the central axis of the tile is substantially equally spaced from the first side and the second side and extends in the longitudinal direction; and at least a riblet has a leading edge and a trailing edge which each comprise a curve in the longitudinal direction, wherein the curve is formed by the union of a convex line and a concave line, wherein the curve has a rising portion in the third direction.

2. The microstructured tile of claim 1, wherein the riblet is symmetrical at the leading and trailing edges.

3. The microstructured tile of claim 1, wherein the riblet is non-symmetrical at the leading and trailing edges.

4. The microstructured tile of claim 1, wherein the predetermined shape of each riblet is a triangular shape.

5. The microstructured tile of claim 1, wherein the predetermined shape of at least one riblet is a triangular shape.

6. The microstructured tile of claim 5, wherein the triangular shape has a side which forms an angle of 15 degrees or less with respect to the vertical axis.

7. The microstructured tile of claim 1, wherein a maximum height of the curve at the leading edge is 1 mm.

8. The microstructured tile of claim 7, wherein a minimum height of the curve at the trailing edge is 0 mm.

9. A multi-functional microstructured tile array, wherein the microstructured tile array comprises a plurality of the microstructured tiles of claim 1, wherein:

the microstructured tiles are of the same design and arranged in a two dimensional array having symmetry along two axes;

the microstructured tiles comprise a plurality of riblets, each riblet having a section curve profile, and wherein the section curve profile comprises a union of a convex line and a concave line;

the spacing between each riblet of the plurality of riblets is a predetermined multiple of the height of the riblets;

a transition area between individual microstructured tiles is flat; and the microstructured tile array comprises a continuously repeatable pattern of the microstructured tiles.

10. The microstructured tile array of claim 9, wherein the spacing between adjacent microstructured tiles forming the microstructured tile array is 1.5 times the height of the riblets.

11. The microstructured tile array of claim 10, wherein the microstructured tile array comprises a continuous thin film sheet.

12. The microstructured tile array of claim 11, wherein the continuous thin film sheet comprises polyethylene.

13. The microstructured tile array of claim 12, wherein the continuous thin film sheet comprises an adhesive backing on one side.

14. The microstructured tile array of claim 13, wherein the microstructured tile array is attachable to a planar or volumetric object.

* * * * *